US008798496B2

(12) United States Patent
Okabe

(10) Patent No.: US 8,798,496 B2
(45) Date of Patent: Aug. 5, 2014

(54) ELECTRO-PHOTOGRAPHIC TYPE IMAGE FORMING DEVICE AND PHOTOSENSITIVE UNIT PROVIDED IN THE SAME

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/358,762

(22) Filed: Jan. 26, 2012

(65) Prior Publication Data

US 2012/0195633 A1 Aug. 2, 2012

(30) Foreign Application Priority Data

Jan. 31, 2011 (JP) ..... 2011-018737
Jan. 31, 2011 (JP) ..... 2011-018738

(51) Int. Cl.
*G03G 21/16* (2006.01)
*G03G 21/18* (2006.01)

(52) U.S. Cl.
CPC ..... *G03G 21/16* (2013.01); *G03G 2221/1684* (2013.01); *G03G 2221/1654* (2013.01); *G03G 2215/0119* (2013.01); *G03G 21/1853* (2013.01)
USPC ..... 399/110

(58) Field of Classification Search
CPC ..... G03G 15/01; G03G 15/00
USPC ..... 399/110, 159, 117; 83/13; 248/201
See application file for complete search history.

(56) References Cited

U.S. PATENT DOCUMENTS 7,426,355 B2 9/2008 Okabe
7,522,858 B2 4/2009 Okabe et al.
7,697,866 B2 * 4/2010 Murayama ..... 399/110
7,756,443 B2 7/2010 Okabe et al.
7,761,023 B2 * 7/2010 Sato ..... 399/90
7,769,320 B2 8/2010 Okabe et al.
7,778,567 B2 8/2010 Igarashi et al.

(Continued)

FOREIGN PATENT DOCUMENTS

JP H10-333375 A 12/1998
JP 2003-015378 * 7/2001 ..... G03G 15/01

(Continued)

OTHER PUBLICATIONS

JP OA Nov. 12, 2013, JP Appln 2011-018737, English translation.

(Continued)

*Primary Examiner* — Clayton E LaBalle
*Assistant Examiner* — Kevin Butler
(74) *Attorney, Agent, or Firm* — Banner & Witcoff, Ltd.

(57) ABSTRACT

An image forming device includes a main casing and a photosensitive unit. The photosensitive unit has a first peripheral portion at a downstream side in an attaching direction provided with a first contact portion and has a second peripheral portion at an upstream side in the attaching direction provided with a second contact portion. The main casing includes a pair of side walls and first and second positioning members. The first and second positioning members span between the side walls. The first positioning member has a first positioning portion with which the first contact portion is contactable for positioning the photosensitive unit relative to the main casing. The second positioning member is positioned upstream of the first positioning member in the attaching direction. The second positioning member has a second positioning portion with which the second contact portion is contactable for positioning the photosensitive unit relative to the main casing.

20 Claims, 13 Drawing Sheets

(56) References Cited

U.S. PATENT DOCUMENTS

| | | | | |
|---|---|---|---|---|
| 7,873,301 | B2 * | 1/2011 | Ishii | 399/111 |
| 7,894,743 | B2 | 2/2011 | Tomatsu | |
| 8,045,883 | B2 | 10/2011 | Okabe et al. | |
| 8,644,728 | B2 | 2/2014 | Okabe | |
| 2003/0053819 | A1 * | 3/2003 | Nomura et al. | 399/110 |
| 2006/0067734 | A1 | 3/2006 | Igarashi et al. | |
| 2007/0036581 | A1 | 2/2007 | Okabe | |
| 2007/0147881 | A1 | 6/2007 | Okabe et al. | |
| 2007/0147885 | A1 | 6/2007 | Okabe et al. | |
| 2008/0002341 | A1 | 1/2008 | Tomatsu | |
| 2009/0092414 | A1 | 4/2009 | Tomatsu | |
| 2009/0202271 | A1 | 8/2009 | Okabe et al. | |
| 2010/0111562 | A1 | 5/2010 | Okabe et al. | |
| 2010/0135692 | A1 * | 6/2010 | Abe et al. | 399/111 |
| 2010/0260518 | A1 * | 10/2010 | Okabe et al. | 399/167 |
| 2012/0008983 | A1 * | 1/2012 | Okabe et al. | 399/159 |
| 2012/0195633 | A1 * | 8/2012 | Okabe | 399/116 |
| 2012/0269547 | A1 * | 10/2012 | Kishi | 399/113 |
| 2013/0084099 | A1 * | 4/2013 | Hashimoto et al. | 399/110 |
| 2013/0251399 | A1 | 9/2013 | OKABE | |

FOREIGN PATENT DOCUMENTS

| | | | | |
|---|---|---|---|---|
| JP | 2001-322311 | A | 11/2001 | |
| JP | 2007-264469 | * | 3/2006 | G03G 15/01 |
| JP | 2006-098772 | A | 4/2006 | |
| JP | 2007-072421 | A | 3/2007 | |
| JP | 2007-178657 | | 7/2007 | |
| JP | 2007-199649 | A | 8/2007 | |
| JP | 2008-009262 | A | 1/2008 | |
| JP | 2009-092859 | A | 4/2009 | |
| JP | 2010-107888 | | 5/2010 | |

OTHER PUBLICATIONS

JP Final Rejection mailed Apr. 1, 2014, JP Appln. 2011-018737, English translation.

* cited by examiner

TOP
FRONT
RIGHT
LEFT
REAR
BOTTOM
12
14K(14)
14Y(14)
14M(14)
14C(14)
43
(61)
39
46
62
34
44
30
15
32
65
33
47
40
38
31
35
42
41
37

ELECTRO-PHOTOGRAPHIC TYPE IMAGE FORMING DEVICE AND PHOTOSENSITIVE UNIT PROVIDED IN THE SAME

CROSS REFERENCE TO RELATED APPLICATION

This application claims priority from Japanese Patent Application Nos. 2011-018738 filed Jan. 31, 2011 and 2011-018737 filed Jan. 31, 2011. The entire content of each of these priority applications is incorporated herein by reference.

TECHNICAL FIELD

The present invention relates to an image forming device including a photosensitive unit.

BACKGROUND

A drum unit of a conventional color printer includes a pair of side plates supporting a plurality of photosensitive drums therebetween. Each rear end portion of each side plate is formed with a notched portion. Further, a front beam constituting a front end portion of the drum unit is inserted with a support shaft. The main casing has metal plates, and a base shaft is spanned between rear end portions of the metal plates. Each metal plate has a front end portion formed with a notched groove. The notched portion of the drum unit is engageable with the base shaft, and each end portion of the support shaft is engageable with each notched groove. Thus, the front and rear end portions of the drum unit can be positioned at a fixed position relative to the main casing.

Further, each side plates of the drum unit has a lower end portion provided with a downwardly protruding portion so as to prevent each photosensitive drum from being in direct contact with a desk when the drum unit is removed from the main casing and placed on the desk.

SUMMARY

The present inventors found that deformation occurs at an edge of the notched groove of the metal plate due to the engagement with the support shaft. The deformation may degrade positioning of the front end portion of the drum unit relative to the main casing.

Further, since the protruding portion of the drum unit also performs positioning of the drum unit relative to the main casing. Therefore, accurate positioning of the drum unit relative to the main casing cannot be performed if the protruding portion is deformed due to the contact with the desk.

It is therefore an object of the present invention to provide an image forming device capable of providing accurate positioning of the drum unit relative to the main casing preventing the front and rear positioning portions from deformation.

Another object of the present invention is to provide a drum unit capable of protecting a contact portion contact with a predetermined portion of the main casing.

In order to attain the above and other objects, the invention provides an image forming device including a main casing and a photosensitive unit attachable to and detachable from the main casing. The photosensitive unit includes a plurality of photosensitive bodies and a pair of side plate sections. The photosensitive bodies are juxtaposedly arrayed and spaced away from each other in an array direction. Each photosensitive body defines a longitudinal direction and has each end portion in the longitudinal direction. The array direction is an attaching direction of the photosensitive unit relative to the main casing. The pair of side plate sections supports each end portion of each photosensitive body and is spaced away from each other in the longitudinal direction. Each side plate section has a first peripheral portion at a downstream side in the attaching direction provided with a first contact portion. The side plate section has a second peripheral portion at an upstream side in the attaching direction provided with a second contact portion. The main casing includes a pair of side walls, a first positioning member, and a second positioning member. The side walls are spaced away from each other in the longitudinal direction. The first positioning member extends in the longitudinal direction and spans between the pair of side walls. The first positioning member has a first positioning portion with which the first contact portion is contactable for positioning the photosensitive unit relative to the main casing. The second positioning member extends in the longitudinal direction and spans between the pair of side walls and is positioned upstream of the first positioning member in the attaching direction. The second positioning member has a second positioning portion with which the second contact portion is contactable for positioning the photosensitive unit relative to the main casing.

According to another aspect, the present invention provides a photosensitive unit detachably attached to a main casing of an image forming device in an attaching direction. The photosensitive unit includes a plurality of photosensitive bodies and a pair of side plate sections. The photosensitive bodies are juxtaposedly arrayed and spaced away from each other in an array direction, each photosensitive body defining a longitudinal direction and having each end portion in the longitudinal direction. The array direction is an attaching direction of the photosensitive unit relative to the main casing. The pair of side plate sections supports each end portion of each photosensitive body and is spaced away from each other in the longitudinal direction. Each side plate section has a positioning contact portion positioned at an upstream side of an outer peripheral portion of the pair of side plate in the attaching direction. Each side plate section has a contact portion positioned at the upstream side of the outer peripheral portion of the pair of side plates and independent of the positioning contact portion. The contact abutment portion is contact with a predetermined portion of the main casing for positioning the pair of side plate sections relative to the main casing. The contact portion is contact with a surface when the photosensitive unit is removed out of the main casing and placed on the surface.

BRIEF DESCRIPTION OF THE DRAWINGS

The particular features and advantages of the invention as well as other objects will become apparent from the following description taken in connection with the accompanying drawings, in which:

FIG. 2(*b*) is an enlarged side view showing an outer protrusion protruding from the process frame shown in FIG. 2(*a*);

DETAILED DESCRIPTION

1. Overview of Printer

Figure 1:
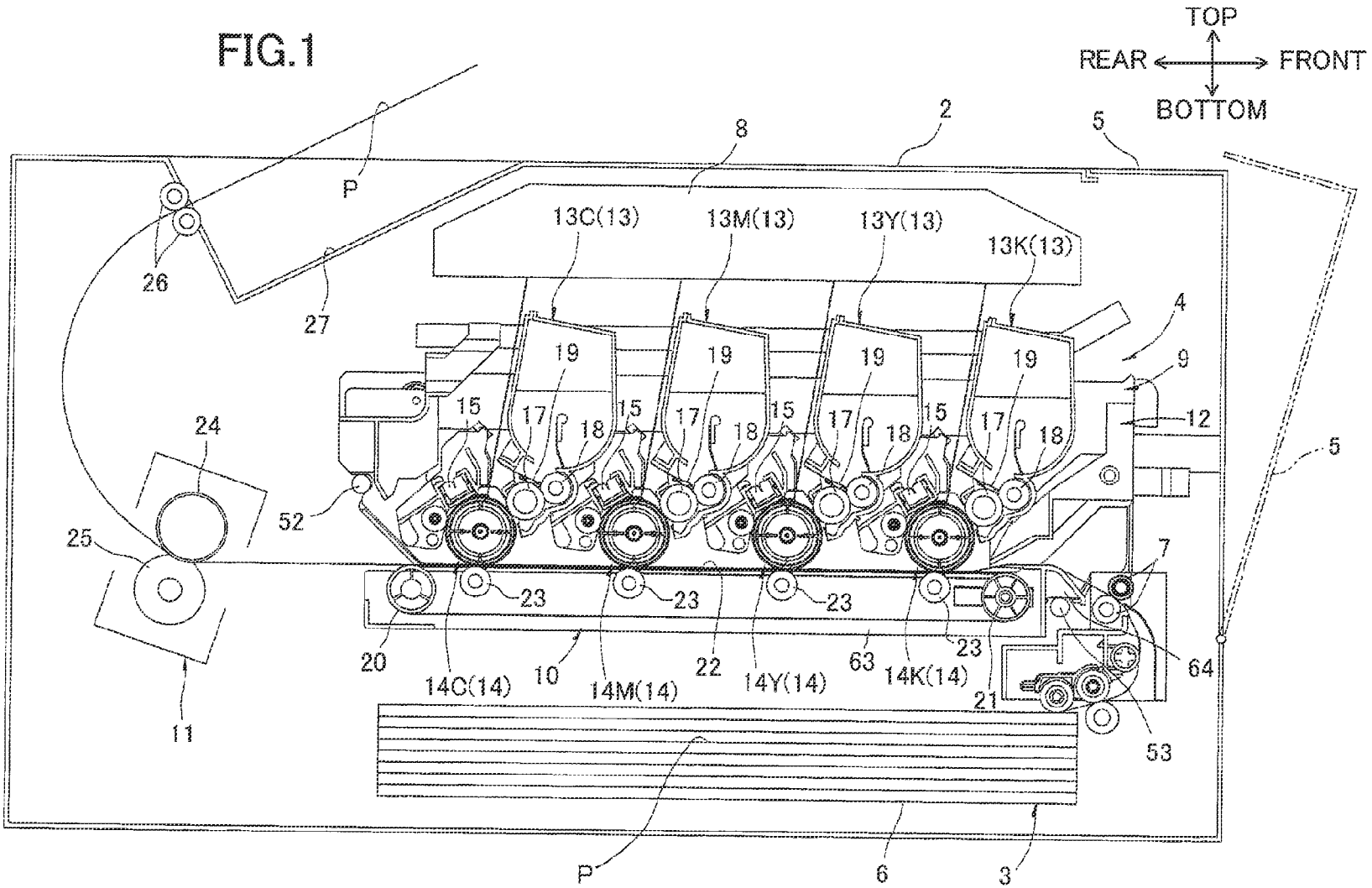
FIG. 1 is a side cross-section view of a printer according to an embodiment of the present invention.

As shown in FIG. 1, a printer 1 is a horizontal direct tandem type color laser printer. The printer 1 includes a main casing 2 and, within the main casing 2, a feeding unit 3 for feeding sheets of paper P to be printed, and an image-forming unit 4 for forming images on the sheets of paper P conveyed from the feeding unit 3.

(1) Main casing

The main casing 2 has a box shape that is substantially rectangular in a side view. The feeding unit 3, image-forming unit 4, and image-reading unit 5 are accommodated in the main casing 2. A front cover 5 is provided on one side wall of the main casing 2 for exposing the inside of the main casing 2 and pivotable about its lower end portion.

In the following description, the side of the printer 1 on which the front cover 5 is provided (right side in FIG. 1) will be referred to as the front side, and the opposite side (left side in FIG. 1) as the rear side. The left and right sides of the printer 1 will be based on the perspective of a user viewing the printer 1 from the front. Hence, the near side of the printer 1 in FIG. 1 is the left side, and the far side is the right side.

(2) Feeding unit

The feeding unit 3 includes a paper feed tray 6 for accommodating sheets of paper P. The paper feed tray 6 is detachably mounted in the bottom section of the main casing 2. A pair of registration rollers 7 are provided above the front end the paper feed tray 6.

The paper P placed in the topmost position in the paper feed tray 6 by various rollers is supplied to the opposing part of the both registration rollers 7 and, after passing between the both registration rollers 7, is conveyed to a position between a photosensitive drum 14 (described later) and an endless conveyer belt 22 (described later).

(3) Image forming unit

The image-forming unit 4 includes a scanner unit 8, a process unit 9, a transfer unit 10, and a fixing unit 11.

(3-1) scanning unit

The scanner unit 8 is disposed in the top section of the main casing 2. As indicated by lines in FIG. 1, the scanner unit 8 irradiates laser beams toward the four photosensitive drums 14 described later based on image data in order to expose the photosensitive drums 14.

(3-2) Process unit (3-2-1) Construction of Process unit

The process unit 9 is positioned below the scanner unit 8 and above the transfer unit 10, and is provided with a single process frame 12 and four developing cartridges 13 each corresponding to each color. The process unit 9 is slidably movable in frontward/rearward direction relative to the main casing 2 between an accommodated position (FIG. 1) where image forming operation can be performed and a pulled out position (FIG. 9) where the process unit 9 is pulled out from the accommodated position. The process unit 9 can be detached from the main casing 2 at the pulled out position for exchanging the used process unit with a new process unit.

The process frame 12 can be slid into or out of the main casing 2 in the front-to-rear direction (attaching direction and detaching direction) and, thus, can be detachably attached to the main casing 2. The process frame 12 retains four photosensitive drums 14 each corresponding to each color, and four Scorotron chargers 15 each corresponding to each photosensitive drum 14.

Four of the photosensitive drums 14 are arranged parallel to one another and oriented with their axes along the left-to-right direction (longitudinal direction of photosensitive drum 14), and are juxtaposed in the left-to-right direction. Specifically, the photosensitive drums 14 include a black photosensitive drum 14K, a yellow photosensitive drum 14Y, a magenta photosensitive drum 14M, and a cyan photosensitive drum 14C arranged in this order from front to back.

The Scorotron chargers 15 are disposed diagonally above and rearward of the respective photosensitive drums 14. The Scorotron chargers 15 face to and are spaced apart the respective photosensitive drums 14.

The developer cartridges 13 are detachably mounted in the process frame 12 in a juxtaposed state above the respective photosensitive drums 14. Specifically, the developer cartridges 13 include a black developing unit 13K, a yellow developing unit 13Y, a magenta developing unit 13M, and a cyan developing unit 13C arranged in this order from front to rear. Each of the developer cartridges 13 is also provided with a developing roller 17.

Each developer cartridge 13 has a developing roller 17, a supply roller 18 for supplying the developing roller 17 with toner, a layer-thickness regulating blade 19 for regulating thickness of toner supplied to the developing roller 17, and a space above those parts for conveying toner in the left-right direction.

Each developing roller 17 is rotatably supported in the lower end of the corresponding developer cartridge 13. The bottom rear edge of the developing roller 17 is exposed through the lower edge of the developing unit 17 and contacts the corresponding photosensitive drum 14 from the top thereof.

(3-2-2) Image Forming Operation

Toner accommodated in each toner cartridge 13 is supplied to the supply roller 18, and then the toner supplied onto the corresponding supply roller 18, in turn the toner is supplied to the developing roller 17. At this time, the toner is positively turbocharged between the supply roller 18 and developing roller 17.

As the developing roller 17 rotates, the thickness-regulating blade 19 regulates the toner carried on the surface of the developing roller 17 to a prescribed thickness, so that the developing roller 17 carries a uniform thin layer of toner thereon.

In the meantime, the Scorotron charger 15 applies a uniform charge of positive polarity to the surface of the corresponding photosensitive drum 14 while the photosensitive drum 14 rotates. Subsequently, the scanner unit 8 irradiates a laser beam (indicated by a line in FIG. 1) in a high-speed scan in order to form an electrostatic latent image on the surface of the respective photosensitive drum 14 based on image data for a respective color corresponding to an image to be formed on a sheet of paper P.

As the photosensitive drum 14 continues to rotate, the positively charged toner carried on the surface of the developing roller 17 is supplied to the electrostatic latent image formed on the surface of the photosensitive drum 14, thereby developing the electrostatic latent image into a visible toner image through reverse development.

(3-3) Transfer unit

The transfer unit 10 is disposed in the main casing 2 above the feeding unit 3 and below the process unit 9 and extends in the front-to-rear direction. The transfer unit 10 includes a drive roller 20, a driven roller 21, the conveyer belt 22, and four transfer rollers 23.

The drive roller 20 and driven roller 21 are disposed parallel to each other and are separated in the front-to-rear direction. The conveyer belt 22 is mounted around the drive roller 20 and driven roller 21, with the top portion of the conveyer belt 22 opposing and contacting each of the photosensitive drums 14 from below. When the drive roller 20 is driven to rotate, the conveyer belt 22 circulates in a counterclockwise when viewed from the left side so that the top portion of the conveyer belt 22 in contact with the photosensitive drums 14 moves rearward for conveying a sheet of paper P rearward.

The transfer rollers 23 are disposed inside the conveyer belt 22 at positions opposing corresponding photosensitive drums 14, with the top portion of the conveyer belt 22 interposed therebetween.

When a sheet of paper P is supplied from the feeding unit 3, the conveyer belt 22 conveys the sheet rearward so that the sheet passes sequentially through each transfer position between the photosensitive drums 14 and corresponding transfer rollers 23. As the sheet is conveyed on the conveyer belt 22, toner images in each color carried on the respective photosensitive drums 14 are sequentially transferred onto the sheet to form a color image.

(3-4) Fixing unit

The fixing unit 11 is disposed to the rear of the transfer unit 10 and includes a heating roller 24, and a pressure roller 25 in confrontation with the heating roller 24. After a color image has been transferred onto the sheet of paper P in the transfer unit 10, the image is fixed to the sheet by a combination of heat and pressure as the sheet passes between the heating roller 24 and pressure roller 25 in the fixing unit 11.

(4) Paper Discharging

After the toner image has been fixed to the paper P, the sheet is conveyed along a U-shaped discharge path (not shown) toward a pair of discharge rollers 26 disposed at the downstream end of the path. The discharge rollers 26 discharge the sheet onto a discharge tray 27 formed on the top of the scanner unit 8.

2. Process Frame

Figures 2A, 2B:
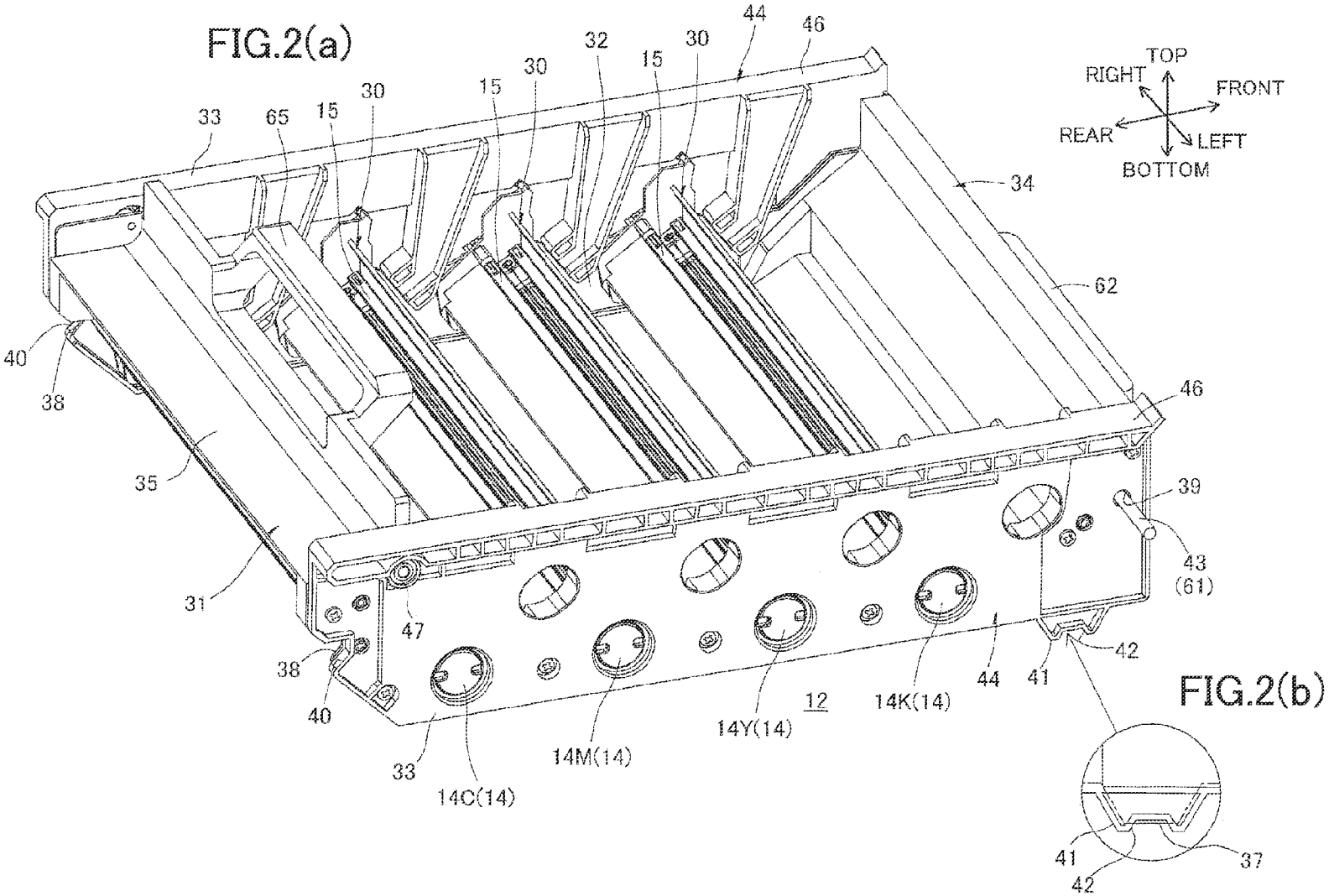
FIG. 2(*a*) is a perspective view of a process frame provided in the printer shown in FIG. 1.
Figure 3:
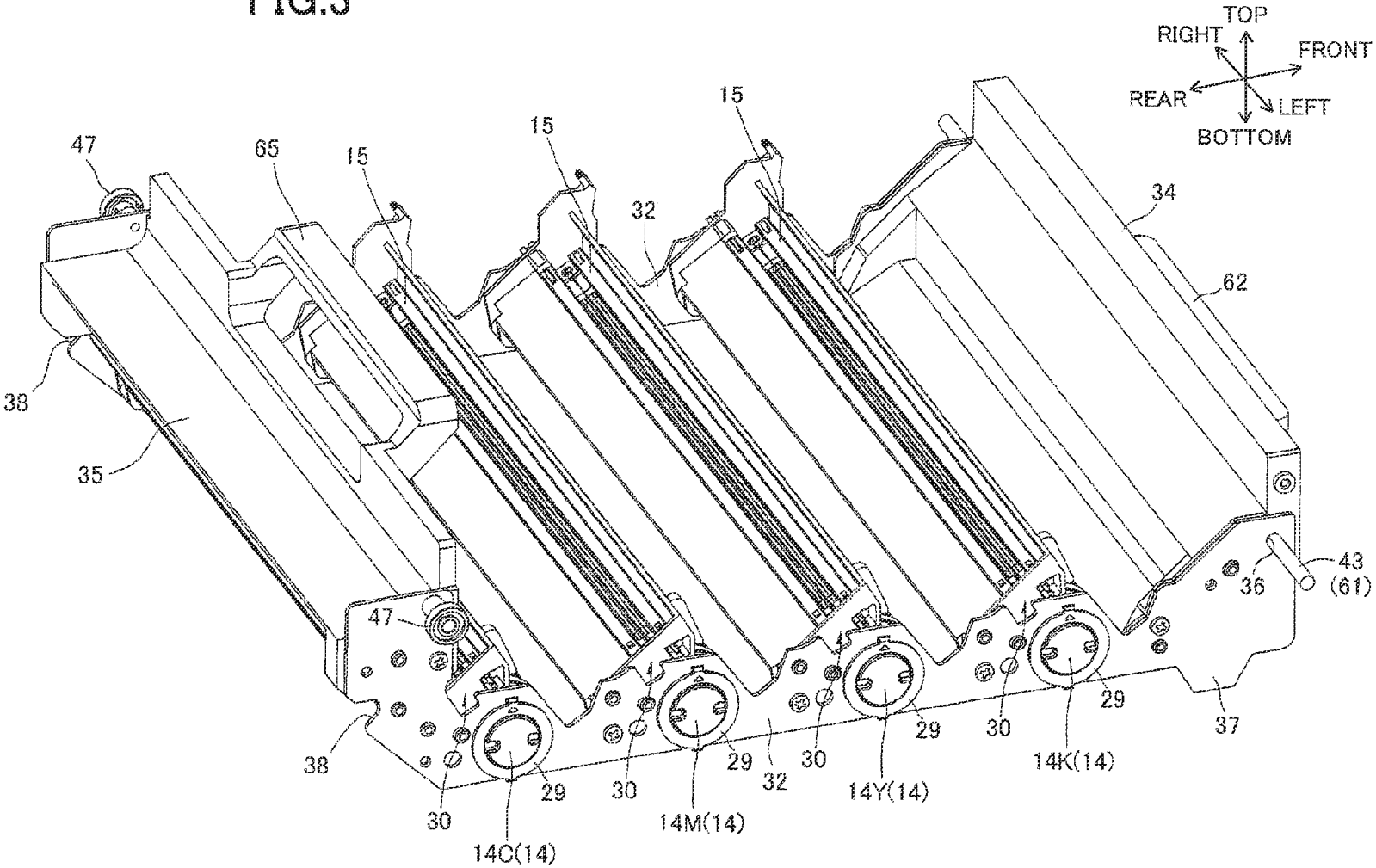
FIG. 3 is a perspective view of the process frame shown in FIG. 2(*a*) when outer side plates are removed from the process frame.

The process frame 12 includes a frame body 31, four photosensitive drums 14, and four drum sub-units 30 as shown in FIGS. 2 and 3.

(1) Frame body

The frame body 31 includes a pair of side plates 44, a front beam 34, and a rear beam 35. Each side plate 44 is rectangular plate shaped in side view, and confronts with each other and spaced away from each other in lateral direction (rightward/leftward direction). Each side plate 44 includes an inner side plate 32 and an outer side plate 33.

(1-1) Inner Side Plate

As shown in FIG. 3, each inner side plate 32 extends in frontward/rearward direction and is rectangular shaped in side view. The inner side plates confront with each other and spaced away from each other in lateral direction. These side plates 32 is produced by a punching and pressing a metal plate with using an identical punching press die. Each inner side plate 32 has a front end portion extending diagonally upward and frontward, and has a rear end portion extending diagonally upward and rearward and then extending upward to provide an L-shape configuration.

The front end portion of each inner side plate is formed with an inner insertion hole 36 and is provided with an inner protrusion 37, while the rear end portion of each inner side plate is formed with an inner notched portion 38. The inner insertion hole 36 is positioned at an upper end portion of the front end portion, and extends through a thickness of the inner side plate 32 for allowing an insertion shaft 61 (described later) to extend therethrough. Each inner protrusion 37 protrudes downward from a lower edge of the inner side plate 32. Each inner protrusion 37 is generally trapezoidal shaped in side view whose lower side is shorter than its upper side. Each inner notched portion 38 is generally V-shaped whose open end is on a rear edge and whose apex (bottom of the notch) is positioned frontward of the open end. Each inner notched portion 38 is adapted to be abutted by and receive a first base shaft 52 (described later, FIG. 6) when the process unit 9 is fully accommodated in the main casing 2. In each inner side plate 32, bearing members 29 are arrayed in the frontward/rearward direction at a position between the inner insertion hole 36 and the inner notched portion 38 for rotatably supporting each lateral end portion of each photosensitive drum 14.

(1-2) Outer Side Plate

Each outer side plate 33 is made from a resin, and as shown in FIG. 2 has a generally rectangular shape in side view whose vertical length is greater than that of the inner side plate 32, and a frontward/rearward length is approximately equal to that of the inner side plate 32. The outer side plates 33 are positioned laterally outside of the inner side plates. That is, each side plate 44 is constituted by each inner side plate 32 and each outer side plate 33.

Each outer side plate 33 has a front end portion formed with an outer insertion hole 39 in alignment with the inner insertion hole 36 of the inner side plate 32, and is provided with an outer protrusion 41 in alignment with the inner protrusion 37 of the inner side plate 32, and has a rear end portion formed with an outer notched portion 40 in alignment with the inner notched portion 38 of the inner side plate 32. The outer protrusion 41 has a profile approximately the same as that of the inner protrusion 37, i.e., trapezoidal shape whose lower side is shorter than the upper side, and slightly larger than the profile of the inner protrusion 37. That is, a lowermost edge of the outer protrusion 41 is positioned lower than a lowermost edge of the inner protrusion 37 in side view as shown in FIG. 2(*b*). Further, in the outer protrusion 41, a recessed portion 42 is formed at an approximately intermediate portion of the lower side in the frontward/rearward direction. Within the recessed portion 42, a part of the lower end portion of the inner protrusion 37 is exposed in side view as shown in FIG. 2(*b*).

The outer notched portion 40 has a notch profile approximately the same as that of the inner notched portion 38, and slightly larger than that of the inner notched portion 38. Thus, within the outer notched portion 40, a peripheral end portion is exposed in side view.

Further, each outer side plate 33 is provided with a guide rail 46 and a roller 47. The guide rail 46 extends in frontward/rearward direction by a length approximately equal to a frontward/rearward length of the outer side plate 33, and protrudes laterally outward from the upper end portion of the outer side plate 33. The roller 47 is rotatably supported to a laterally outer side of the outer side plate 33 at a position below a rear end portion of the guide rail 46.

(1-3) Front Beam and Rear Beam

The front beam 34 is spanned between the front end portions of the inner side plates 32 and is provided with the insertion shaft 61 extending through the front beam 34 in lateral direction. Each lateral end portion of the insertion shaft 61 extends through the inner insertion hole 36 (FIG. 3) and the outer insertion hole 39 (FIG. 2) and protrudes laterally outward of the outer side plate 33. Each lateral end portion of the insertion shaft 61 functions as a protruding portion 43 protruding laterally outward of the inner and outer side plates 32, 33. The front beam 34 has a laterally intermediate portion provided with a front grip portion 62. The rear beam 35 is spanned between the rear end portions of the inner side plate 32, and has a laterally intermediate portion provided with a rear grip portion 65.

(2) Drum Sub-Unit

Four drum sub-units 30 are positioned between the inner side plates 32 and between the front beam 34 and the rear beam 35, and are arrayed in frontward/rearward direction at a constant interval. Each drum sub-unit 30 is positioned rearward of each photosensitive drum 14. Each drum sub-unit 30 extends in lateral direction and has a triangular prism shape. Each Scorotron charger 15 extends along and is held to each drum sub-unit 30.

3. Details of Main Casing 2

Figure 4:
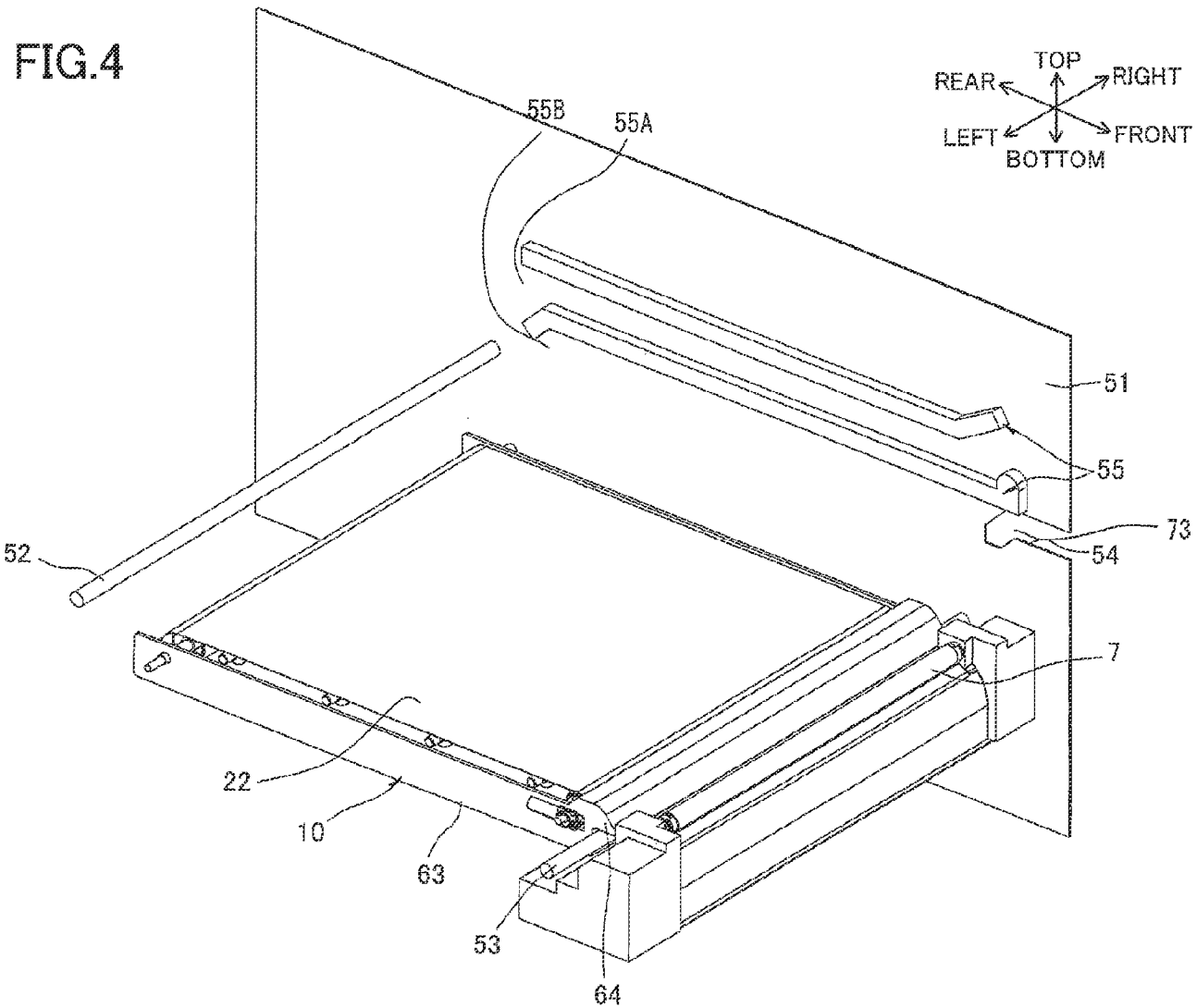
FIG. 4 is a perspective view of a main casing provided in the printer shown in FIG. 1.
Figure 5:
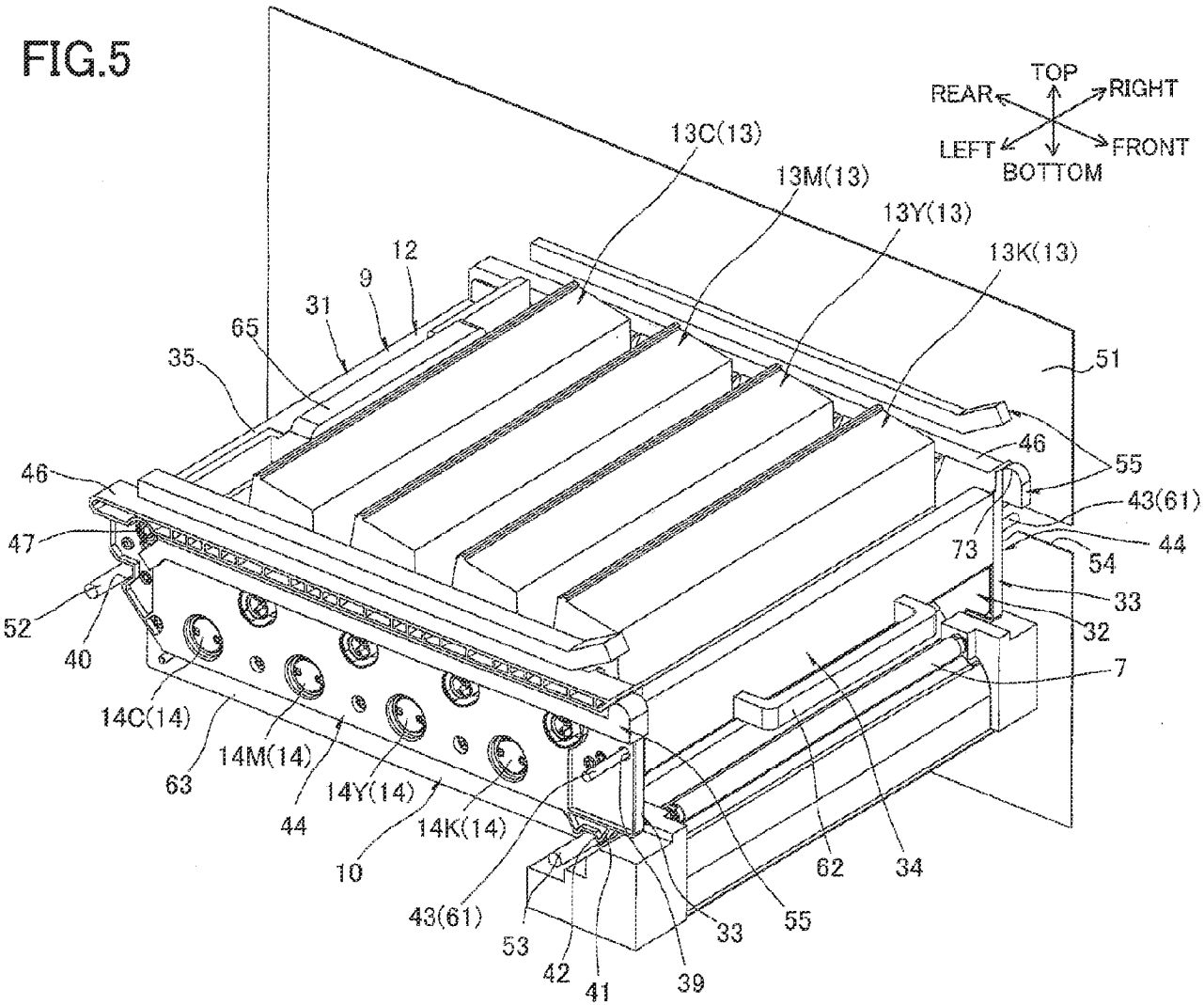
FIG. 5 is an explanatory perspective view showing the process frame when the process frame is attached to the main casing in an accommodated position.
Figure 6:
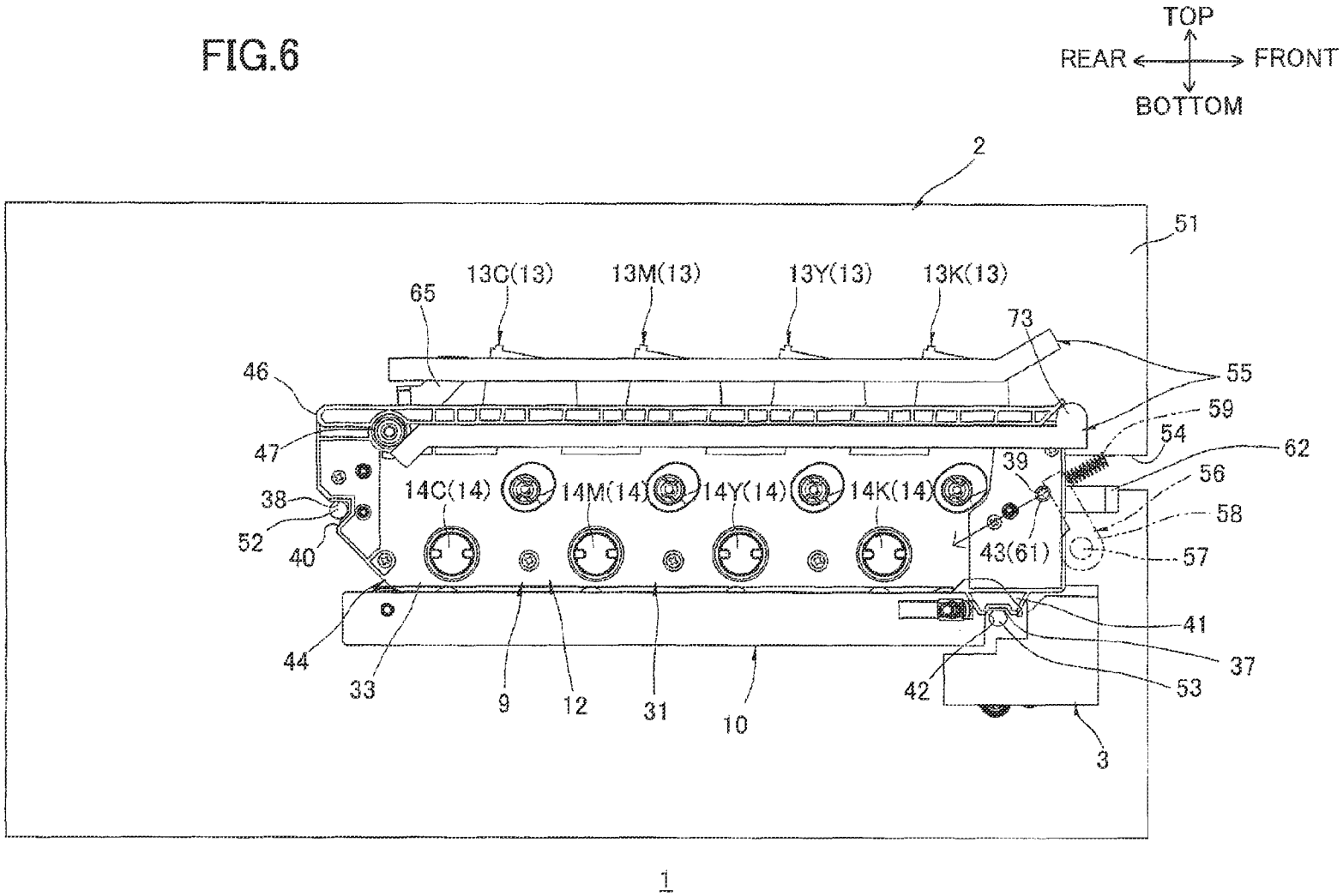
FIG. 6 is an explanatory side view showing the process frame when the process frame is disposed in the accommodated position.

As shown in FIG. 4, the main casing 2 includes a pair of side walls 51, the first base shaft 52, and a second base shaft 53. The side walls 51 confront with each other and spaced away from each other in rightward/leftward direction. The side walls 51 are made from a metal and is generally plate shaped and are spaced away from each other in lateral direction. Each side wall 51 is formed with a shaft insertion groove 54, and is provided with main guide rails 55 and a pair of pressure mechanisms 56 (FIG. 6).

The shaft insertion groove 54 is positioned at vertically intermediate position of the front end portion of the side wall 51. The shaft insertion groove 54 is of notched shape, such that a groove depth of the shaft insertion groove 54 extends rearward from a front end face of the side wall 51, and is bent diagonally downward and further rearward. A width of the shaft insertion groove 54 is greater than a diameter of the insertion shaft 61 so that the insertion groove 54 can receive therein the insertion shaft 61 without direct contact therebetween.

The main guide rails 55 include upper and lower guide rails 55A, 55B and are positioned at generally vertically center portion of the main casing 2, and extend in frontward/rearward direction from a position near the shaft insertion groove 54 to a position near the first base shaft 52. The upper guide rail 55A is adapted to guide an upper surface of the guide rail 46 during loading of the process unit 9. The upper guide rail 55A has a front end portion bent diagonally upward and frontward.

The rear guide rail 55B is adapted to support the roller 47. That is, the roller 47 runs on an upper surface of the rear guide rail 55B during loading of the process unit 9. The rear guide rail 55B has a rear end portion bend diagonally downward and rearward, and has a front end portion provided with a stop portion 73. The stop portion 73 has a semi-circular shape in side view protruding upward.

Figure 7:
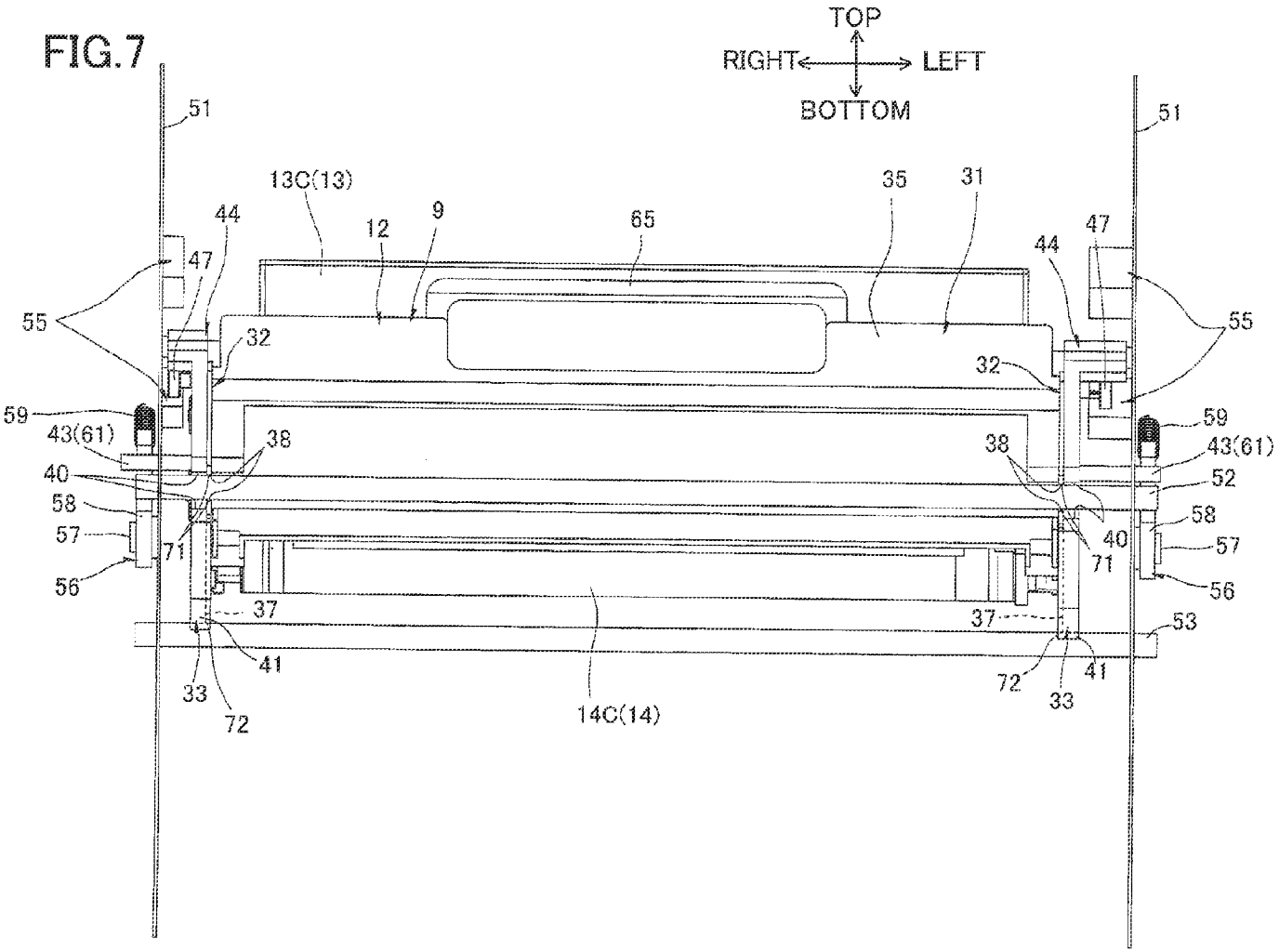
FIG. 7 is an explanatory rear view showing the process frame when the process frame is disposed in the accommodated position.

As shown in FIGS. 6 and 7, each pressure mechanism 56 is positioned at laterally outer side of each front end portion of the side wall 51 and adjacent to the shaft insertion hole 54. Each pressure mechanism 56 includes a pivot shaft 57, and a pressure arm 58. The pivot shaft 57 is positioned below the shaft insertion groove 54 and protrudes laterally outward from a laterally outer surface of the side wall 51. The pressure arm 58 is of lever shape and has a lower end portion pivotally movably supported to the pivot shaft 57. By the pivotal movement of the pressure arm 58 about the pivot shaft 57, an upper end portion of the pressure arm 58 can be moved along the shaft insertion groove 54. A compression spring 59 is provided to contact a front side surface of the upper end portion of the pressure arm 58 such that the upper end portion of the pressure arm 58 is urged rearward by the urging force of the compression spring 59.

As shown in FIGS. 1, 4 and 7, the first base shaft 52 is positioned above a rear end portion of the transfer unit 10 and at approximately vertically intermediate portion of the side wall 51. The first base shaft 52 is spanned between the pair of side walls 51 and has a generally cylindrical shape, and is made from a metal.

The second base shaft 53 is positioned between the registration roller 7 and the driven roller 21 and the front lower end portion of the side wall 51. The second base shaft 53 is spanned between the pair of side walls 51 and is a solid cylindrical rod and is made from a metal. That is, the second base shaft 53 is positioned frontward of and spaced away from the first base shaft 52.

4. Positioning Transfer Unit and Process Frame

As shown in FIGS. 1 and 4, the transfer unit 10 includes the drive roller 20, the driven roller 21, and the belt frame 63 supporting each lateral end portion of each transfer roller 23. The belt frame 63 is rectangular shaped in side view and has a front upper end portion provided with a sheet guide portion 64 protruding frontward. The sheet guide portion 64 has rectangular triangle shape whose apex portion is positioned frontward. More specifically, the sheet guide portion 64 has a linear sheet guide surface extending diagonally frontward and downward from the front upper edge of the transfer unit 10, and the sheet guide portion 64 has a linear lower surface extending in frontward/rearward direction. Further, the apex portion (the frontmost portion) of the sheet guide portion 64 is in confrontation with a rear side of a nip portion defined between the registration rollers 7. The front end portion of the transfer unit 10 is subjected to positioning relative to the second base shaft 53 by abutment of the lower surface of the sheet guide portion 64 onto the second base shaft 53 from above.

At the accommodated position of the process unit 9 relative to the main casing 2, the inner notched portions 38 is fitted with the first base shaft 52, and the inner protrusions 37 are fitted with the second base shaft 53. More specifically, the front outer peripheral surface of each lateral end portion of the first base shaft 52 functions as a first positioning portion 71 (FIG. 7) with which the inner notched portion 38 is contact, and the upper outer peripheral surface of each lateral end portion of the second base shaft 53 functions as a second positioning portion 72 (FIG. 7) with which the inner protrusion 37 is contact.

In this case, mechanical interference between the outer notched portion 40 and the first base shaft 52 is prevented, and mechanical interference between the outer protrusion 41 and the second base shaft 53 is also prevented. Further in this case, the protruding portion 43 of the insertion shaft 61 extends through the rear end portion of the shaft insertion groove 54 in such a manner that mechanical interference between the insertion shaft 61 and a peripheral surface of the shaft insertion groove 54 is prevented. The protruding portion 43 further extends laterally outward of the side wall 51 through the insertion groove 54.

The pressure arm 58 is abutted and seated on the protruding portion 43 protruding outward of the side wall 51 such that the pressure arm 58 urges the protruding portion 43 diagonally rearward and downward as shown in FIG. 6 in order to produce a first force component directing rearward and a second force component directing downward.

In this way, the rear end portion of the process unit 9 can be subjected to positioning relative to the main casing 2 such that the inner notched portions 38 is subjected to positioning relative to the first base shaft 52 because of the pressure applied to the inner notched portion 38 against the first positioning portion 71, and further, the front end portion of the process unit 9 can be subjected to positioning relative to the main casing 2 such that the inner protrusion 37 is subjected to positioning relative to the second base shaft 53 because of the pressure applied to the inner protrusion 37 against the second positioning portion 72.

The outer peripheral portion of the inner side plates 32 are repeatedly abutted against the first and second base shafts 52, 53 for repeated exchange of an old process cartridge 9 with a new process cartridge 9 due to loading and unloading movement of the process cartridge 9. In this case, deformation may occur in the outer peripheral portion of the inner side plates 32 due to the abutment against the first and second base shafts 52, 53. Here, the outer peripheral portion of the inner side plates 32 is much more deformable than the deformation of the first and second base shafts 52, 53. In other words, deformation degree of the first and second base shafts 52, 53 is less than that of the outer peripheral portion of the inner side plates 32. That is, deformation of the first and second base shafts 52, 53 due to abutment against the inner side plates 32 can be prevented. Consequently, deformation of the first and second positioning portions 71, 72 of the main casing 2 can be prevented, thereby providing accurate positioning of the process unit 9 relative to the main casing 2.

Here, deformation of the outer peripheral portion of the inner side plates 32 may be promoted due to the abutment against the first and second base shafts 52, 53. Then, positioning of the process unit 9 relative to the main casing 2 may be degraded. However, the photosensitive drums 14 may be degraded due to repeated printing operation prior to degradation of positioning, and thus, the process unit 9 must be replaced by a new process unit 9. In other words, excessive deformation does not occur by the periodical exchange of the process unit 9, the "periodical" implying an ordinary frequency of exchange. Thus, accurate positioning of the process unit 9 relative to the main casing 2 can be performed. As a result, repairing of an expensive printer or replacement of an old printer with a new printer is not required, but a periodical exchange of a consumable goods, i.e., the process unit 9 with a new process unit 9 is only required for using the printer with a prolonged service life.

Further, as described above, the second base shaft 53 is positioned between the driven roller 21 and the pair of registration rollers 7. Therefore, positioning of the front end portion of the process unit 9 relative to the main casing 2 can be performed at a position adjacent to the registration rollers 7. Consequently, the sheet P can be smoothly conveyed from the registration rollers 7 to a portion between the photosensitive drum 14K for black color and the conveyer belt 22.

Further, as described above in connection with FIG. 6, each pressure arm 58 of each pressure mechanism 56 is adapted to press each projecting portion 43 of the insertion shaft 61 diagonally downward and rearward, such that component force directing rearward and other component force directing downward can be generated. Therefore, positioning of the rear end portion of the process unit 9 relative to the first base shaft 52 can be performed by pressing each peripheral surface of each inner notched portion 38 against the first positioning portion 71, and at the same time, positioning of the front end portion of the process unit 9 relative to the second base shaft 53 can be performed by pressing each lower end face of each inner protrusion 37 against the second positioning portion 72. That is, positioning of the front and rear end portions of the process unit 9 relative to the main casing 2 can be simultaneously performed with a simple structure.

Further, as described above, each inner side plate 32 is produced by punching and pressing the metal plate using the identical punching press die. Therefore, the inner side plate 32 has identical shape to each other with a precise dimensional accuracy. Consequently, an interval between neighboring photosensitive drums 14 in the frontward/rearward direction can be accurately provided.

Further, as described above, the first and second base shafts 52, 53 are made from metal. Therefore, these shafts can have sufficient rigidity. Consequently, deformation of the first and second positioning portions 71, 72 due to abutment of the inner notched portions 38 and inner projection 37 can be avoided.

Further, the second base shaft 53 has a cylindrical shape extending in lateral direction. Therefore, rigid second base shaft 53 can be obtained with the simple construction avoiding deformation of the positioning portions.

5. Sliding Movement of Process Unit

Figure 8:
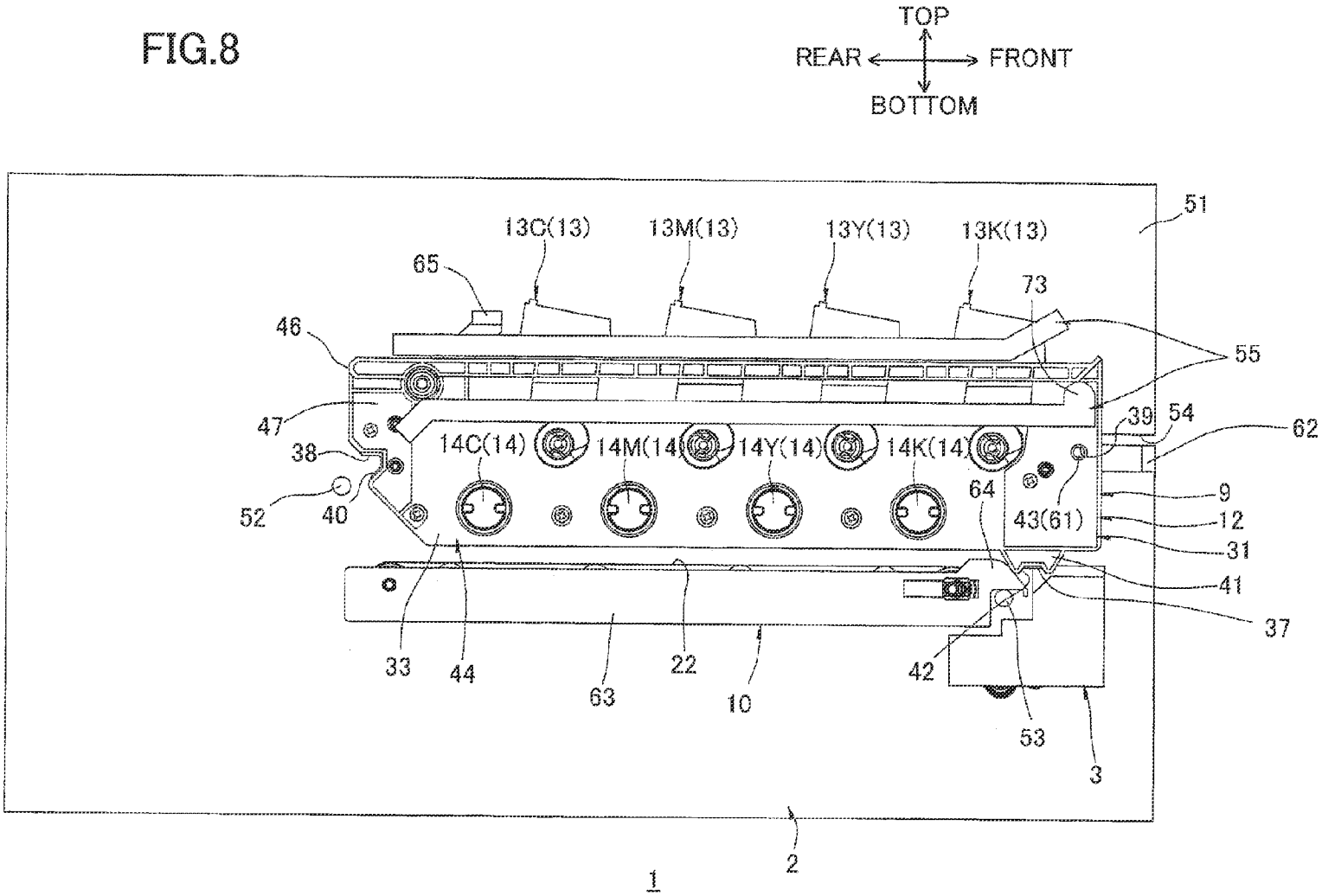
FIG. 8 is an explanatory side view showing the process frame when the process frame is disposed between the accommodated position and a pulled-out position.
Figure 9:
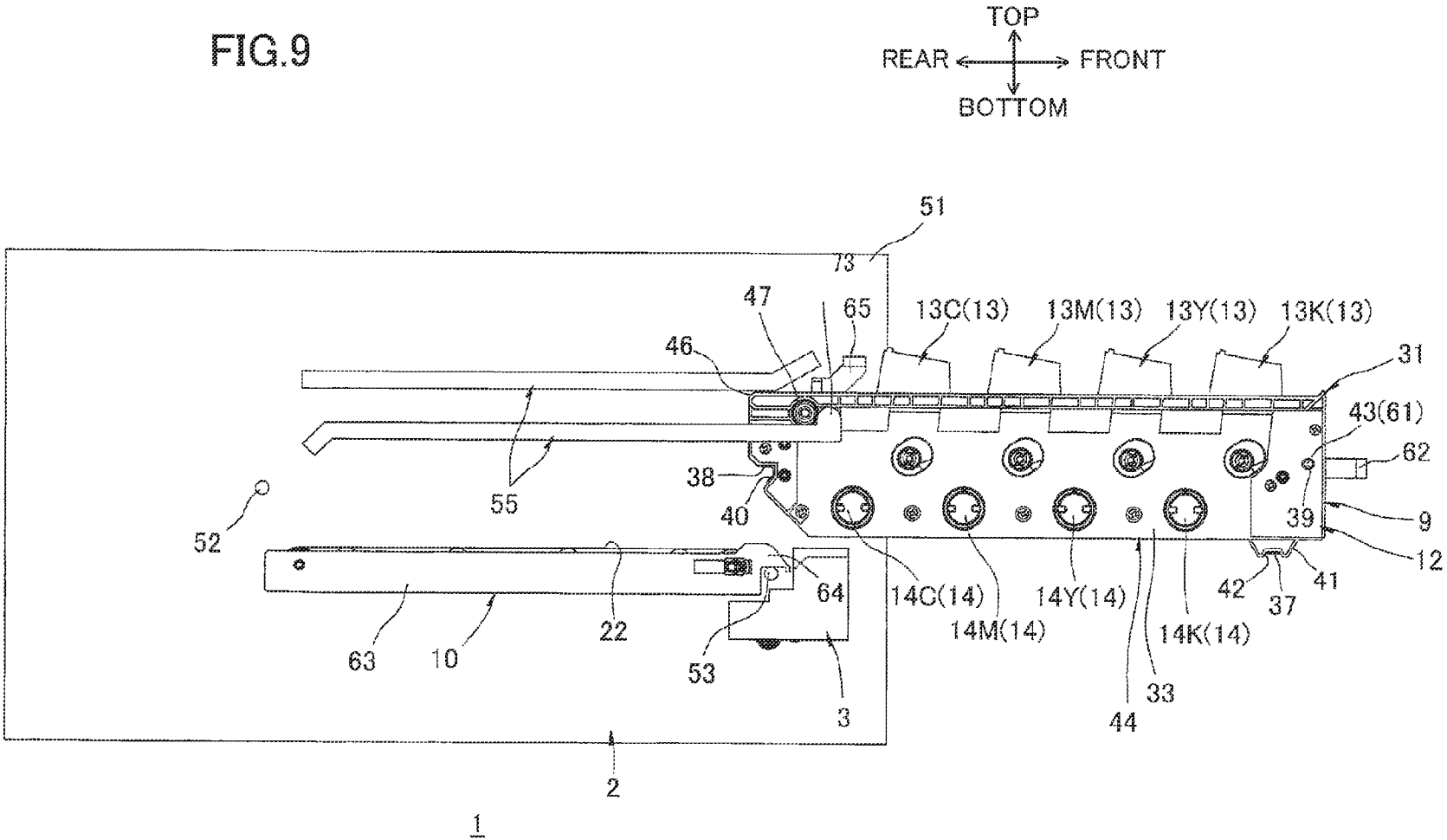
FIG. 9 is an explanatory side view showing the process frame when the process frame is disposed in the pulled-out position.

Sliding movement of the process unit 9 relative to the main casing 2 will be described with reference to FIGS. 8 and 9. For slidingly moving the process unit 9 from the accommodated position to the pulled-out position, a user grips the front grip potion 62 and pulls the process unit 9 frontward. Then, as shown in FIG. 8, the process unit 9 is moved diagonally upward and frontward because of the guide by the rear end portion of the lower guide 55B. Thus, the inner notched portion 38 is moved frontward away from the first base shaft 52, and the inner protrusion 37 is moved upward away from the second base shaft 53, and at the same time, each photosensitive drum 14 is moved upward away from the conveyer belt 22.

By further pulling the process unit 9 frontward, the process unit 9 is moved frontward along the main guide rails 55, and the roller 47 is brought into abutment with the stop portion 73 provided at the lower guide rail 55B. Thus, further frontward sliding movement of the process unit 9 is prevented. As a result, the process unit 9 is positioned at the pulled-out position as shown in FIG. 9.

For removing the process unit 9 which has been moved to the pulled-out position from the main casing 2, the rear grip portion 65 is gripped while the front grip portion 62 is being gripped, and then, the process unit 9 is pulled diagonally upward and frontward while the front end portion of the process unit 9 is moved upward. Then, the roller 47 can be rolled on the stop portion 73 and can be moved past the stop portion 73, whereupon the process unit 9 is removed from the main casing 2.

Loading the process unit 9 on the accommodated position in the main casing 2 can be performed by reversing the above process. That is, the front and rear grip portions 62, 65 are gripped such that the process unit 9 has an inclined posture in which its front end portion is positioned higher than its rear end portion. While maintaining this posture, the rear end portion of the process unit 9 is inserted into the main casing 2 such that the roller 47 abuts on the stop portion 73. The roller can be rolled on the stop portion 73 and can be moved past the stop portion 73. Thus, the process unit 9 can be moved into the main casing 2. Then, orientation of the process unit 2 is changed to be horizontal, and the process unit 2 is pushed rearward, whereupon the process unit 9 is moved to the accommodated position by way of guide by the main guide rails 55.

6. Placing Process Unit Removed from Main Casing

Figure 10:
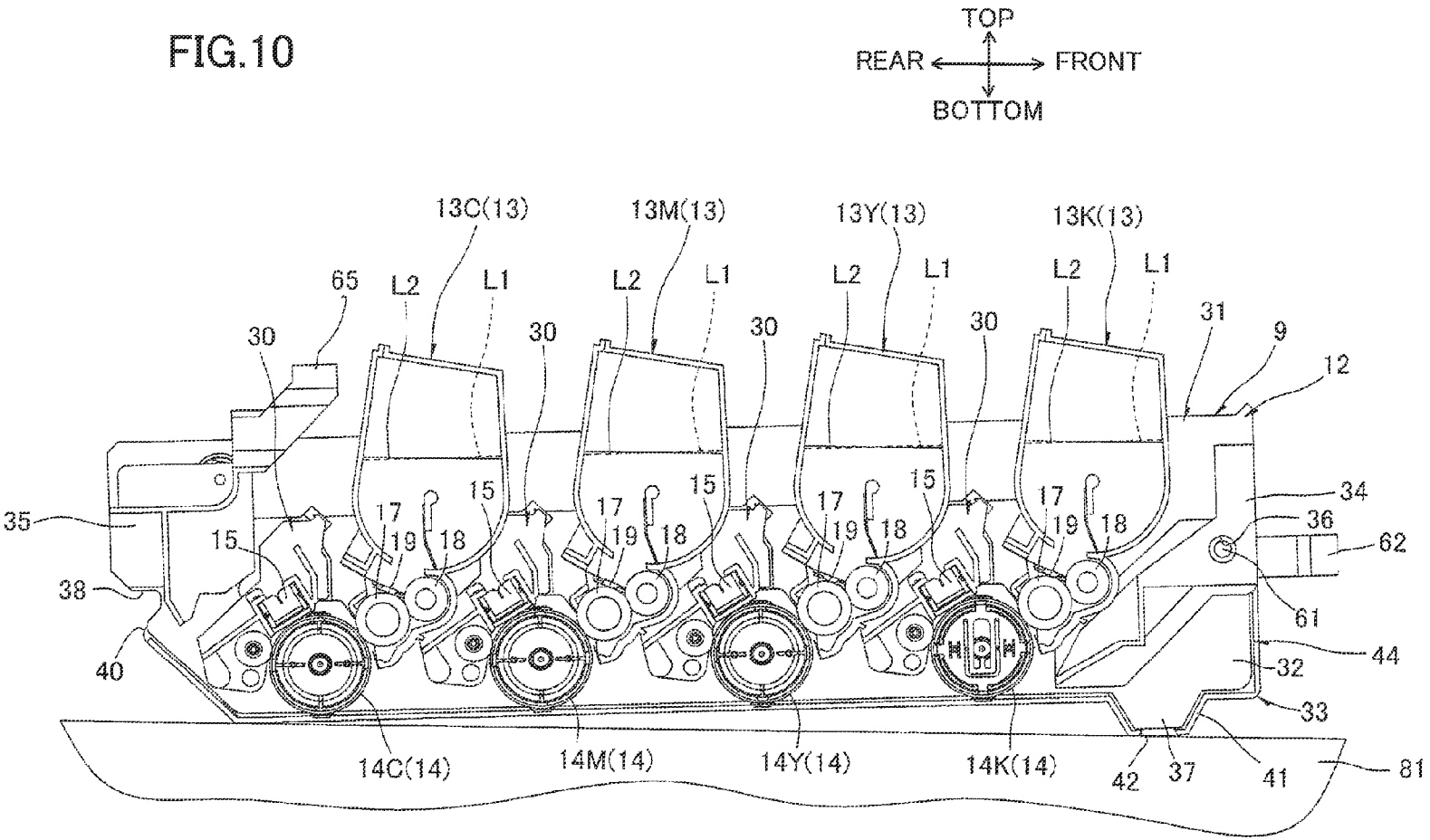
FIG. 10 is an explanatory side cross-section view showing the process frame when the process frame is removed from the main casing and is placed on an installation surface.

As shown in FIG. 10, the process unit 9 which has been removed from the main casing 2 is mounted on a flat surface 81 such as a top surface of a desk. In this case, a lower end portion of the outer protrusion 41 and a rear lower end portion of the outer side plate 33 are contacted with the flat surface 81. Accordingly, the process unit 9 has an inclined posture in which a bottom surface of the process unit 9 is diagonally oriented upward toward its front side. This inclination degree is steeper than an inclination degree when the process unit 9 is at the accommodated position. In other words, the toner in each toner container provides a level L1 as indicated by a solid line when the process unit 9 is placed at the accommodated position, whereas the toner level L2 as indicated by a broken like is provided when the process unit 9 is placed on the surface 81.

Because the outer protrusion 41 is abutted on the surface 81 while the inner protrusion 37 is slightly spaced away from the flat surface 81, the inner protrusion 37 can be protected when the process unit 9 is removed from the main casing 2 and mounted on the table. Further, since the inner protrusion 37 is made from metal while the outer protrusion 41 is made from resin, the outer protrusion 41 does not positively damage the surface 81 while the inner protrusion 37 has a certain rigidity. Thus, when mounting the process unit 9 on the table, not only the inner protrusion 37 but also the surface 81 of the table can be protected.

Further, because of the inclination of the process unit when mounting on the table surface 81, each photosensitive drum 14 can be positioned spaced away from the flat surface 81, so that the photosensitive drums 14 can be protected against inadvertent contact. Further, because the posture of the process unit 9 when mounted on the table surface 81 (FIG. 10) is different from the posture when accommodated in the main casing 2 (FIG. 6), the toner surface level is changed between L1 and L2. This implies that mobility or fluidity of the toner can be enhanced only by placing the process unit 9 on the surface 81.

7. Modifications

Figure 11:
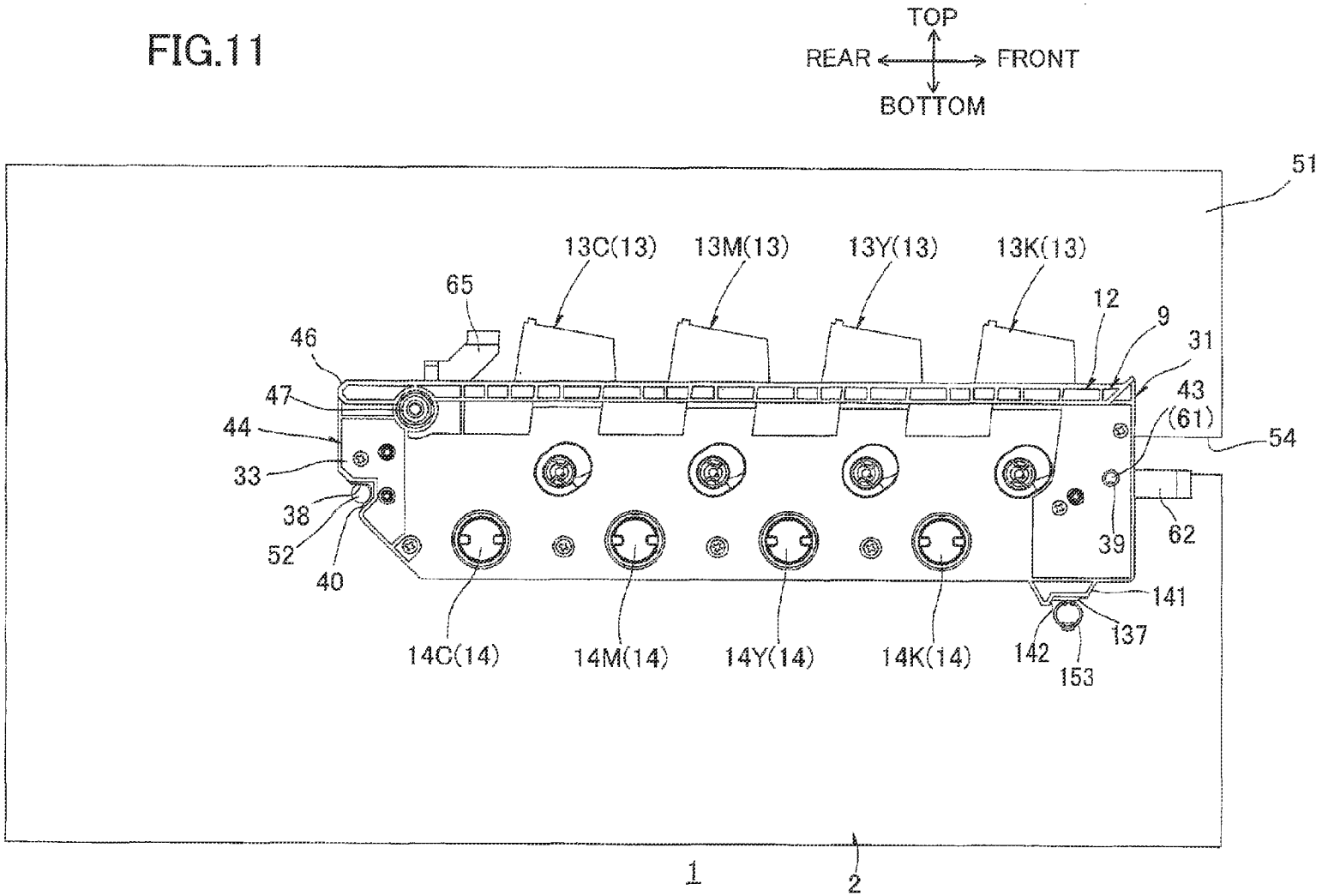
FIG. 11 is an explanatory perspective view of a printer according to a first modification of the present invention.

A color printer according to a first modification will next be described with reference to FIG. 11, wherein like parts and components are designated by the same reference numerals as those shown in FIGS. 1 through 10. According to the embodiment, the second base shaft 53 is the solid cylinder. On the other hand according to the first modification, a second base shaft 153 is a hollow cylinder. Further, an outer protrusion 141 has a notched portion 142 instead of the recessed portion 42. Of course, the notched portion 142 is configured to expose the lower end portion of the inner protrusion 37.

Figure 12:
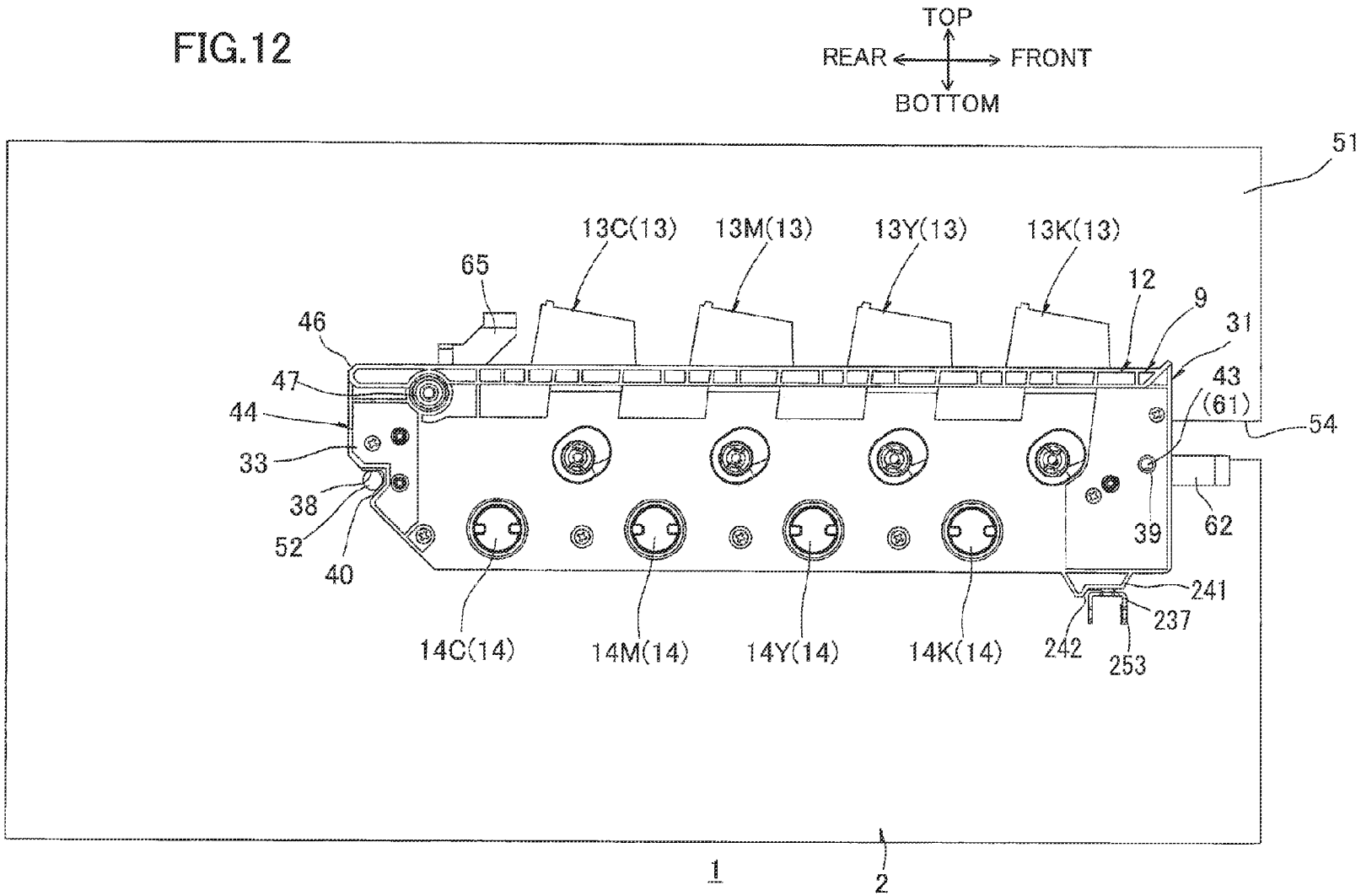
FIG. 12 is an explanatory perspective view of a printer according to a second modification of the present invention.

FIG. 12 shows a color printer according to a second modification in which a second base shaft 253 has an inverted U-shape in side view. Further, an outer protrusion 241 has a notched portion 242 similar to the notched portion 142. The notched portion has a shape so as to conform with an outer peripheral profile of the U-shaped second base shaft 253. In any event, the lower end portion of the inner protrusion 37 is exposed through the notched portion 22.

Figure 13:
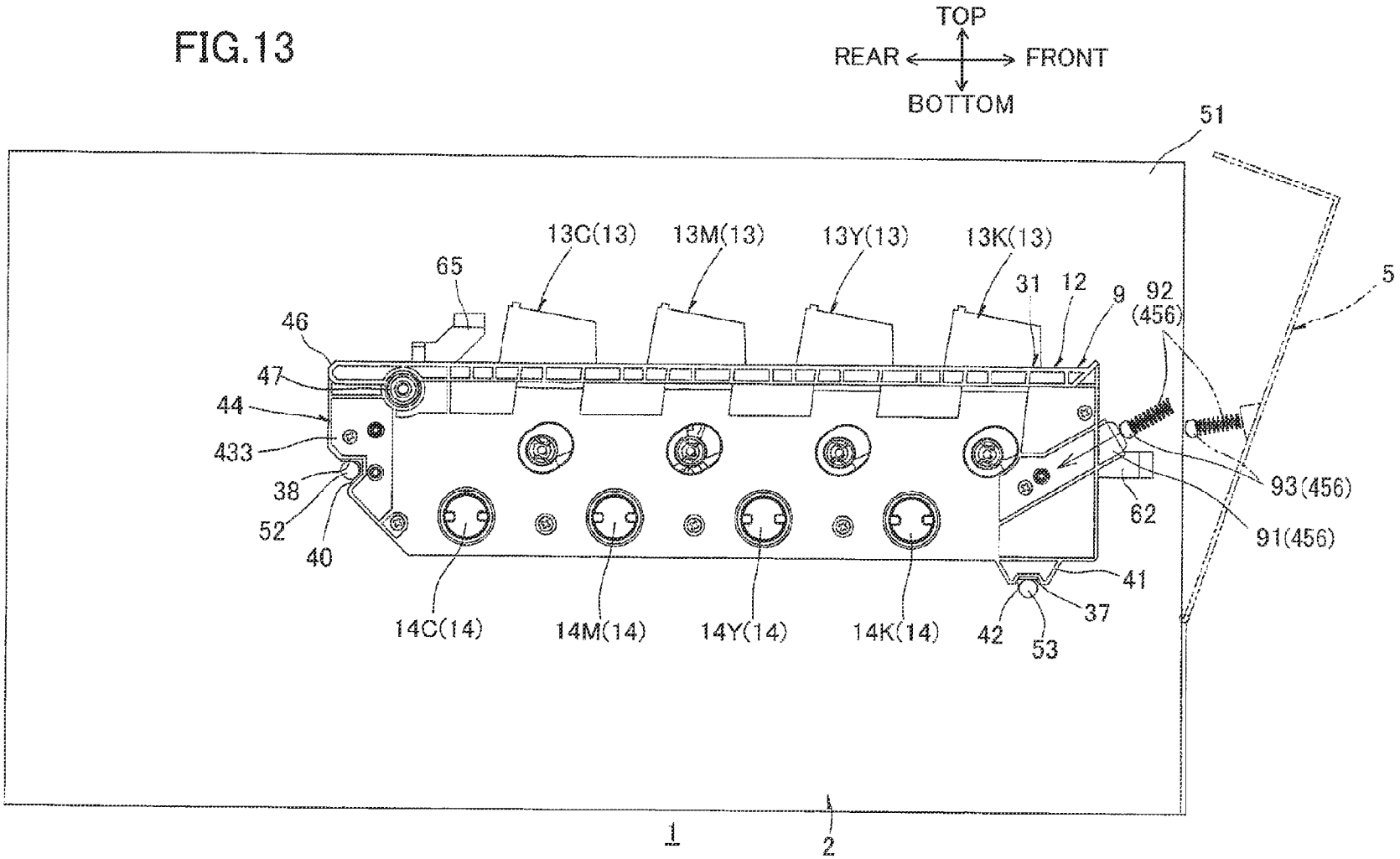
FIG. 13 is an explanatory perspective view of a printer according to a third modification of the present invention.

FIG. 13 shows a color printer according to a third modification. According to the first embodiment, each lateral end portion 43 of the insertion shaft 61 extending through the front beam 34 protrudes laterally outward of each outer side plate 33, and each pressure arm 58 of each pressure mechanism 56 presses each lateral end portion 43. On the other hand according to the pressure mechanism 456 of the third modification, a pressed portion 91 extends diagonally upward and frontward from each front end portion of each outer side plate 433, and a pressure member 93 is supported to a front cover 5 through a compression spring 92 for pressing the pressed portion 91 diagonally downward and rearward such that a force component directing downward and another force component directing rearward can be generated.

The pressed portion 91 is generally rectangular shape in side view and has a front end face inclined downward toward the front cover 5. Further, a combination of the pressure member 93 and the compression spring 92 extends diagonally downward and rearward toward the pressed portion 91 when the front cover 5 is closed. The pressure member 93 has an abutment surface in abutment with the pressed portion 91. The abutment surface has a semicircular cross-section. The compression spring 92 is interposed between the rear face of the front cover 5 and a front face of the pressure member 93.

A peripheral surface of the inner notched portion 38 is pressed against the first positioning portion 71 for positioning the rear end portion of the process unit 9 relative to the first base shaft 52, and a peripheral surface of the inner protrusion 37 is pressed against the second positioning portion 72 for positioning the front end portion of the process unit 9 relative to the second base shaft 53. Such pressing force is obtained by the abutment between the pressed portion 91 and the pressure member 93. Thus, positioning of front and rear end portions of the process unit 9 relative to the main casing 2 can be simultaneously performed with the simple construction.

In the first embodiment, an interlocking mechanism (not shown) can be provided so that in the pressure mechanism 56 pressure can be applied to the pressure arm 58 in interlocking relation to the closing movement of the front cover 5, and the pressure can be released in interlocking relation to the opening movement of the front cover 5. The above-described modifications can perform the function the same as the first embodiment.

While the invention has been described in detail with reference to the embodiments thereof, it would be apparent to those skilled in the art that various changes and modifications may be made therein without departing from the spirit of the invention.

What is claimed is:

1. An image forming device comprising:

a main casing; and a photosensitive unit attachable to and detachable from the main casing and comprising:

a plurality of photosensitive bodies juxtaposedly arrayed and spaced away from each other in an array direction, each photosensitive body defining a longitudinal direction and having each end portion in the longitudinal direction, the array direction being an attaching direction of the photosensitive unit relative to the main casing; and a pair of side plate sections supporting each end portion of each photosensitive body and spaced away from each other in the longitudinal direction, each side plate section having a first peripheral portion at a downstream side in the attaching direction provided with a first contact portion, and having a second peripheral portion at an upstream side in the attaching direction provided with a second contact portion;

the main casing comprising:

a pair of side walls spaced away from each other in the longitudinal direction;

a first positioning member extending in the longitudinal direction and spanning between the pair of side walls, the first positioning member having a first positioning portion with which the first contact portion is contactable for positioning the photosensitive unit relative to the main casing; and a second positioning member extending in the longitudinal direction and spanning between and fixed to the pair of side walls and positioned upstream of the first positioning member in the attaching direction, the second positioning member having a second positioning portion with which the second contact portion is contactable for positioning the photosensitive unit relative to the main casing, the second positioning member having a first engagement portion and a second engagement portion, the first engagement portion engaging with one of the pair of side walls, the second engagement portion engaging with another of the pair of side walls.

2. The image forming device according to claim 1, wherein the first positioning member, the second positioning member, the first contact portion and the second contact portion have a geometrical relationship such that contact between the first positioning member and the first contact portion occurs simultaneously with abutment between the second positioning member and the second contact portion.

3. The image forming device according to claim 1, further comprising:

a belt unit comprising:

a pair of rollers spaced away from each other in the array direction; and an endless belt mounted on the pair of rollers including an upstream side roller and a downstream side roller in the attaching direction; and a conveying portion positioned at an upstream side of the belt unit in the attaching direction for conveying a sheet to a portion between each photosensitive body and the endless belt, the second positioning member being positioned between the conveying portion and the upstream side roller.

4. The image forming device according to claim 1, wherein the first contact portion is contactable with the first positioning portion in a first contacting direction, and the second contact portion is contactable with the second positioning portion in a second contacting direction; and the image forming device further comprises a pressure member configured to press the side plate sections with a first component force directing in the first contacting direction and with a second component force directing in the second contacting direction.

5. The image forming device according to claim 4, wherein the photosensitive unit further comprises a beam member spanning between the pair of side plate sections, the beam member having a protruding portion protruding outward from each side plate section in the longitudinal direction, the pressure member being configured to press each protruding portion with the first component force and the second component force.

6. The image forming device according to claim 1, wherein the pair of side plate sections is a product obtained by punching and pressing a metal plate with an identical punching press die.

7. The image forming device according to claim 1, wherein the first positioning member and the second positioning member are made from metal.

8. The image forming device according to claim 1, wherein the second positioning member has a cylindrical shape extending in the longitudinal direction.

9. A photosensitive unit detachably attached to a main casing of an image forming device in an attaching direction, comprising:

a plurality of photosensitive bodies juxtaposedly arrayed and spaced away from each other in an array direction, each photosensitive body defining a longitudinal direction and having each end portion in the longitudinal direction, the array direction being an attaching direction of the photosensitive unit relative to the main casing; and a pair of side plate sections supporting each end portion of each photosensitive body and spaced away from each other in the longitudinal direction, each side plate section having a first positioning contact portion and a contact portion, the first positioning contact portion being positioned at an upstream side of an outer peripheral portion of the pair of side plate sections in the attaching direction, the contact portion being positioned at the upstream side of the outer peripheral portion of the pair of side plate sections and independent of the first positioning contact portion, the first positioning contact portion being contactable with a predetermined portion of the main casing for positioning the pair of side plate sections relative to the main casing when the photosensitive unit is accommodated in the main casing, and the contact portion being contactable with a surface when the photosensitive unit is removed out of the main casing and placed on the surface.

10. The photosensitive unit according to claim 9, wherein the first positioning contact portion is made from metal, and the contact portion is made from a resin.

11. The photosensitive unit according to claim 10, wherein each side plate section comprises an inner side plate made from the metal and an outer side plate positioned outside the inner side plate in the longitudinal direction and made from the resin, the first positioning contact portion being provided in the inner side plate, and the contact portion being provided in the outer side plate.

12. The photosensitive unit according to claim 11, wherein the first positioning contact portion and the contact portion are overlapped with each other in the longitudinal direction, the contact portion having a lower end lower than a lower end of the first positioning contact portion.

13. The photosensitive unit according to claim 9, wherein the contact portion is configured such that when an entire photosensitive unit is placed on the surface, the entire photosensitive unit is inclined relative to the surface at an angle steeper than an inclination angle of the entire photosensitive unit when the photosensitive unit is accommodated in the main casing.

14. The photosensitive unit according to claim 9, wherein each side plate section further has a second positioning contact portion positioned downstream side of the first positioning contact portion in the attaching direction, the second positioning contact portion being provided on the outer peripheral portion of the pair of side plate sections.

15. The photosensitive unit according to claim 9, wherein each of the side plate sections includes a metal plate and a resin plate;

wherein the first positioning contact portion is provided on the metal plate; and wherein the contact portion is provided on the resin plate.

16. The photosensitive unit according to claim 9, wherein the contact portion has a lower end lower than a lower end of the first positioning contact portion.

17. A photosensitive unit movable between an outside position where the photosensitive unit is disposed outside of a main casing of an image forming device and an inside position where the photosensitive unit is accommodated in the main casing, the photosensitive unit configured to move from the outside position to the inside position in an attaching direction, the photosensitive unit comprising:

a plurality of photosensitive bodies juxtaposedly arrayed and spaced away from each other in an array direction, each photosensitive body defining a longitudinal direction and having each end portion in the longitudinal direction, the array direction being an attaching direction of the photosensitive unit relative to the main casing; and a pair of side plate sections supporting each end portion of each photosensitive body and spaced away from each other in the longitudinal direction, each side plate section having a first positioning contact portion and a contact portion, the first positioning contact portion being positioned at an upstream side of an outer peripheral portion of the pair of side plate sections in the attaching direction, the contact portion being positioned at the upstream side of the outer peripheral portion of the pair of side plate sections and independent of the first positioning contact portion, the first positioning contact portion being contactable with a predetermined portion of the main casing for positioning the pair of side plate sections relative to the main casing when the photosensitive unit is disposed in the inside position, and the contact portion being contactable with a surface when the photosensitive unit is disposed in the outside position and placed on the surface.

18. The photosensitive unit according to claim 17, wherein the photosensitive unit is attachable to and detachable from the main casing.

19. The photosensitive unit according to claim 17, wherein each of the side plate sections includes a metal plate and a resin plate;

wherein the first positioning contact portion is provided on the metal plate; and wherein the contact portion is provided on the resin plate.

20. The photosensitive unit according to claim 17, wherein the contact portion has a lower end lower than a lower end of the first positioning contact portion.

* * * * *